US012798749B2

(12) United States Patent
Nishikawa et al.

(10) Patent No.: US 12,798,749 B2
(45) Date of Patent: Nov. 17, 2026

(54) REMOTE CONTROL DEVICE AND DISPLAY DEVICE FOR REMOTELY CONTROLLING PROPULSION OF A SHIP

(71) Applicant: SUZUKI MOTOR CORPORATION, Hamamatsu (JP)

(72) Inventors: Akihiro Nishikawa, Hamamatsu (JP); Kentaro Araki, Hamamatsu (JP); Takumi Sasaki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 62 days.

(21) Appl. No.: 18/956,572

(22) Filed: Nov. 22, 2024

(65) Prior Publication Data

US 2025/0229882 A1 Jul. 17, 2025

(30) Foreign Application Priority Data

Jan. 17, 2024 (JP) ..... 2024-005066

(51) Int. Cl.

| | |
|---|---|
| ***B63H 21/21*** | (2006.01) |
| ***B63B 49/00*** | (2006.01) |
| ***B63H 25/02*** | (2006.01) |

(52) U.S. Cl.

CPC ..... *B63H 21/213* (2013.01); *B63B 49/00* (2013.01); *B63H 2021/216* (2013.01)

(58) Field of Classification Search

CPC .. B63H 21/213; B63H 2021/216; B63B 49/00
See application file for complete search history.

(56) References Cited

U.S. PATENT DOCUMENTS

| | | | | |
|---|---|---|---|---|
| 2007/0249244 | A1* | 10/2007 | Watanabe | B63H 21/213 440/84 |
| 2011/0297072 | A1* | 12/2011 | Bratas | B63B 49/00 114/343 |
| 2016/0249468 | A1* | 8/2016 | Laster | H05K 5/0217 |
| 2018/0134362 | A1* | 5/2018 | Despineux | B63H 21/213 |
| 2018/0284564 | A1* | 10/2018 | Arita | B60K 35/22 |
| 2019/0025869 | A1 | 1/2019 | Parazynski | G05G 1/01 |

(Continued)

FOREIGN PATENT DOCUMENTS

| | | | |
|---|---|---|---|
| CN | 215851825 U | * | 2/2022 |
| CN | 216158700 U | | 4/2022 |
| JP | 2022-176618 A | | 11/2022 |

OTHER PUBLICATIONS

Machine Translation of Foreign Reference: CN215851825U—Chen et al. (Year: 2021).*

*Primary Examiner* — Scott A Browne
*Assistant Examiner* — Rami Nabih Bedewi
(74) *Attorney, Agent, or Firm* — Stein IP LLC

(57) ABSTRACT

A remote control device for remotely controlling a ship propulsion device provided in a ship. The remote control device includes a remote control device main body including a main body case installed on an installation surface provided in the ship, and a remote control lever attached to the main body case, a display unit provided outside the main body case, and including a display case and a display provided in the display case, and a support mechanism that couples the display unit and the remote control device main body to each other, and that supports the display unit such that the display unit is disposed at a position separated from the remote control device main body.

3 Claims, 18 Drawing Sheets

(56) References Cited

U.S. PATENT DOCUMENTS

| | | | | |
|---|---|---|---|---|
| 2022/0033046 | A1* | 2/2022 | Despineux | B63H 21/17 |
| 2022/0363360 | A1* | 11/2022 | Kimpara | B63H 20/12 |
| 2023/0166597 | A1* | 6/2023 | Günther | B60K 35/50<br>296/70 |

* cited by examiner

REMOTE CONTROL DEVICE AND DISPLAY DEVICE FOR REMOTELY CONTROLLING PROPULSION OF A SHIP

CROSS-REFERENCE TO RELATED APPLICATIONS

This application is based on and claims priority under 35 USC 119 from Japanese Patent Application No. 2024-005066 filed on Jan. 17, 2024, the entire content of which is incorporated herein by reference.

TECHNICAL FIELD

The present disclosure relates to a remote control device for remotely controlling a ship propulsion device.

BACKGROUND ART

In many cases, a remote control device for remotely controlling a ship propulsion device such as an outboard motor is installed in a console, which is an operator console or a control console, provided in a ship. The remote control device is provided with a remote control lever, and a ship operator can control a magnitude or a direction of a propulsive force generated by the ship propulsion device by performing an operation of tilting the remote control lever.

JP2022-176618A discloses a remote control device in which a display is incorporated in a housing, and various kinds of information related to a ship propulsion device or a ship can be displayed on the display.

In a case where a display is incorporated in a housing of a remote control device, the housing is increased in size. As a result, in order to install the remote control device on a console of a ship, a wide installation surface is required on the console. However, in a small ship, a ship in which a hull is not small but a console is small, or a ship in which a console is not small but a large number of devices are installed on the console and an available space is small, it may be difficult to ensure a wide installation surface on the console. In this case, it is difficult to install the remote control device in the ship.

In addition, for example, visibility or designability of information display can be improved by displaying information on the display using graphics, such as drawing an image of a meter on the display and displaying a speed, a rotational frequency, or the like using the image. In addition, convenience can be further improved by displaying a large amount of information on the display in an easily viewable manner at the same time. In order to realize this, it is desirable to provide a large display having a large number of pixels in the remote control device. However, in a case where the large display is incorporated in the housing of the remote control device, the housing is further increased in size, and a wider installation surface is further required on the console when the remote control device is installed on the console.

SUMMARY OF INVENTION

Aspect of non-limiting embodiments of the present disclosure relates to provide a remote control device capable of preventing an increase in area of an installation surface on a ship side required for installation of the remote control device even in a case where the display is provided in the remote control device.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a remote control device for remotely controlling a ship propulsion device provided in a ship, the remote control device includes:

- a remote control device main body including:
  - a main body case installed on an installation surface provided in the ship; and
  - a remote control lever attached to the main body case;
- a display unit provided outside the main body case, and including a display case and a display provided in the display case; and
- a support mechanism that couples the display unit and the remote control device main body to each other, and that supports the display unit such that the display unit is disposed at a position separated from the remote control device main body.

BRIEF DESCRIPTION OF DRAWINGS

Exemplary embodiment(s) of the present invention will be described in detail based on the following figures, wherein.

DESCRIPTION OF EMBODIMENTS

Figure 1A:
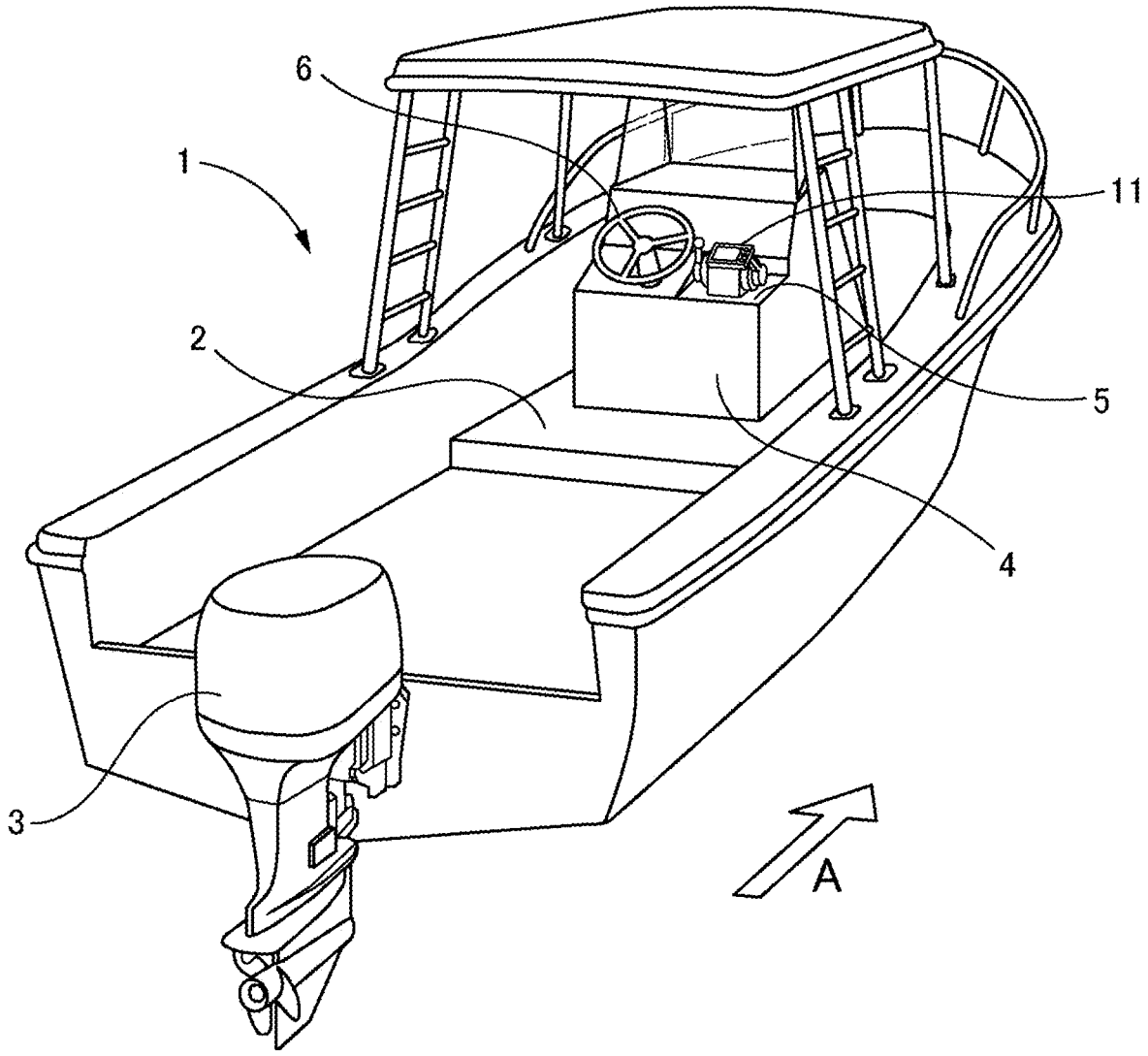
FIG. 1A is a perspective view illustrating a ship provided with a remote control device according to a first embodiment of the present disclosure.

A remote control device according to an embodiment of the present disclosure is a device for remotely controlling a ship propulsion device provided in a ship. The remote control device of the present embodiment includes a remote control device main body, a display unit, and a support mechanism.

The remote control device main body includes a main body case and a remote control lever attached to the main body case. The main body case is installed on an installation surface provided in the ship, for example, an installation surface of a console provided in the ship.

The display unit includes a display case and a display provided in the display case. In addition, the display unit is provided outside the main body case of the remote control device main body.

The support mechanism supports the display unit such that the display unit and the remote control device main body are coupled to each other and the display unit is disposed at a position separated from the remote control device main body.

In the remote control device of the present embodiment, the main body case of the remote control device main body is installed on the installation surface provided in the ship. Accordingly, in a case where the main body case is large, an area of the installation surface on a hull side required for installation of the remote control device becomes large, and in a case where the main body case is small, the area of the installation surface on the hull side required for installation of the remote control device becomes small. In the remote control device of the present embodiment, the display unit is provided outside the main body case of the remote control device main body and is disposed at a position separated from the remote control device main body, so that the main body case of the remote control device main body can be made smaller as compared to a case where the display unit is provided inside the main body case of the remote control device main body. Accordingly, according to the remote control device of the present embodiment, even in a case where the display is provided in the remote control device, it is possible to prevent an increase in area of an installation surface on a ship side required for installation of the remote control device. In addition, according to the remote control device of the present embodiment, even in a case where the display provided in the remote control device is increased in size, it is possible to prevent the increase in area of the installation surface on the ship side required for installation of the remote control device.

First Embodiment

A first embodiment of the remote control device according to the present disclosure will be described with reference to FIGS. 1A to 7.

In the first embodiment, a direction of the ship is described based on a person standing at the center of a deck of the ship while facing a bow of the ship. Specifically, the front of the person, that is, a direction of the bow is considered as the front of the ship, the upper of the person is considered as the upper of the ship, and the right of the person is considered as the right of the ship. Hollow arrows A in FIGS. 1A to 5D and 7 indicate a forward direction of the ship. A direction of the remote control device is determined separately from the direction of the ship. The direction of the remote control device is determined based on the installation surface on which the remote control device is installed. Specifically, a direction perpendicular to the installation surface is defined as an up-down direction, a direction perpendicular to the up-down direction is defined as a front-back direction, and a direction perpendicular to the up-down direction and the front-back direction is defined as a left-right direction. In FIGS. 1A to 5D and 7, an arrow Fd indicates the front of the remote control device, an arrow Bd indicates the back of the remote control device, an arrow Ud indicates the upper of the remote control device, an arrow Dd indicates the lower of the remote control device, an arrow Ld indicates the left of the remote control device, and an arrow Rd indicates the right of the remote control device.

(Ship)

FIG. 1A illustrates a ship 1 provided with a remote control device 11 according to the first embodiment of the present disclosure. As illustrated in FIG. 1A, an outboard motor 3 is provided at a stern of the ship 1. In addition, a deck 2 of the ship 1 is provided with a console 4. The outboard motor 3 is a specific example of a "ship propulsion device".

(Console)

Figure 1B:
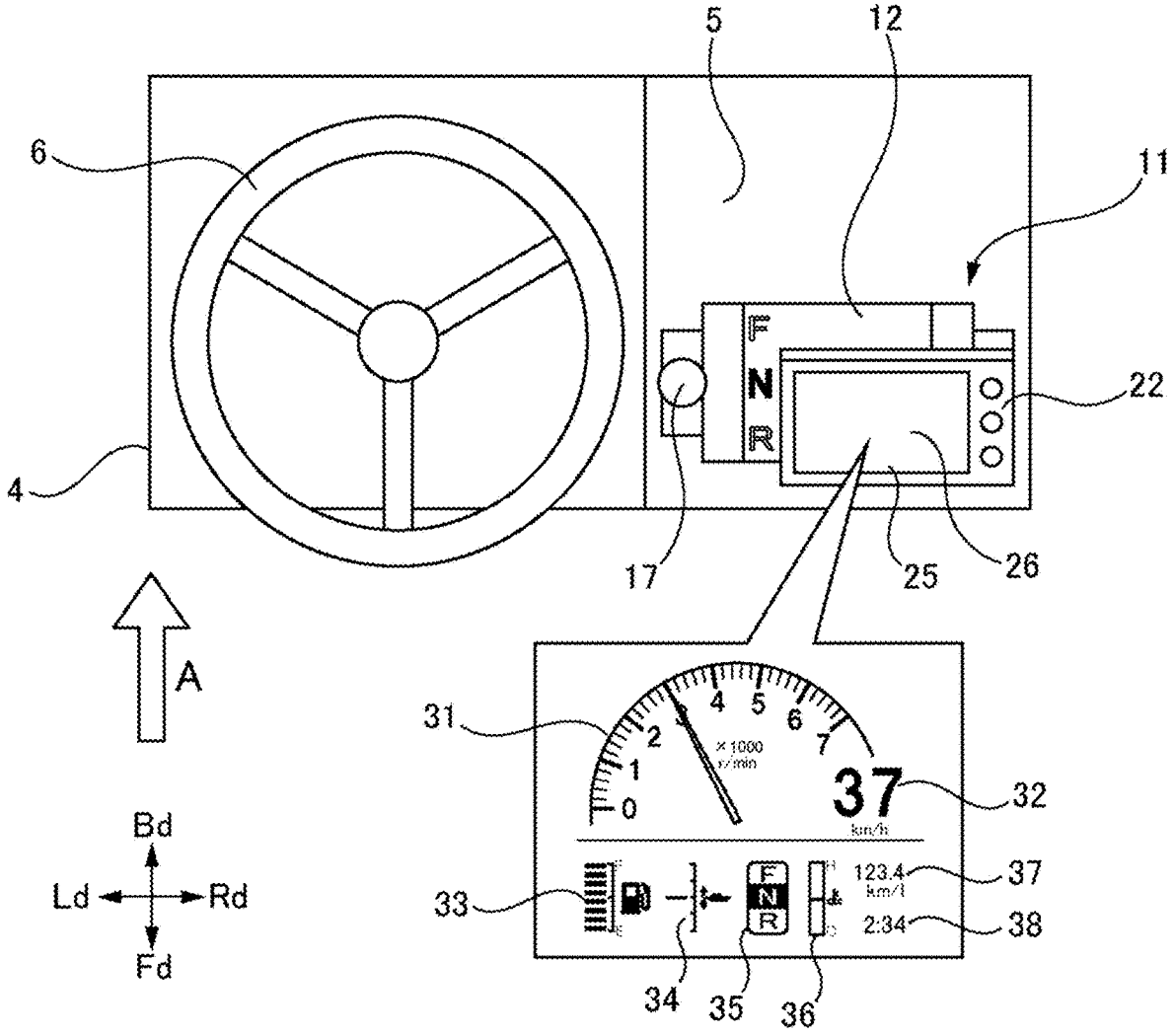
FIG. 1B is an explanatory view illustrating a console and the like provided in the ship.

FIG. 1B illustrates the console 4 as viewed from above. As illustrated in FIG. 1B, a steering wheel 6 is provided on a left portion of an upper surface of the console 4. In addition, an installation surface 5 is formed on a right portion of the upper surface of the console 4. The installation surface 5 is a flat surface and is horizontal. The remote control device 11 is provided on the installation surface 5. The remote control device 11 is installed on the horizontal installation surface 5 such that a rear surface of the remote control device 11 faces the front of the ship 1.

(Remote Control Device)

Figure 2:
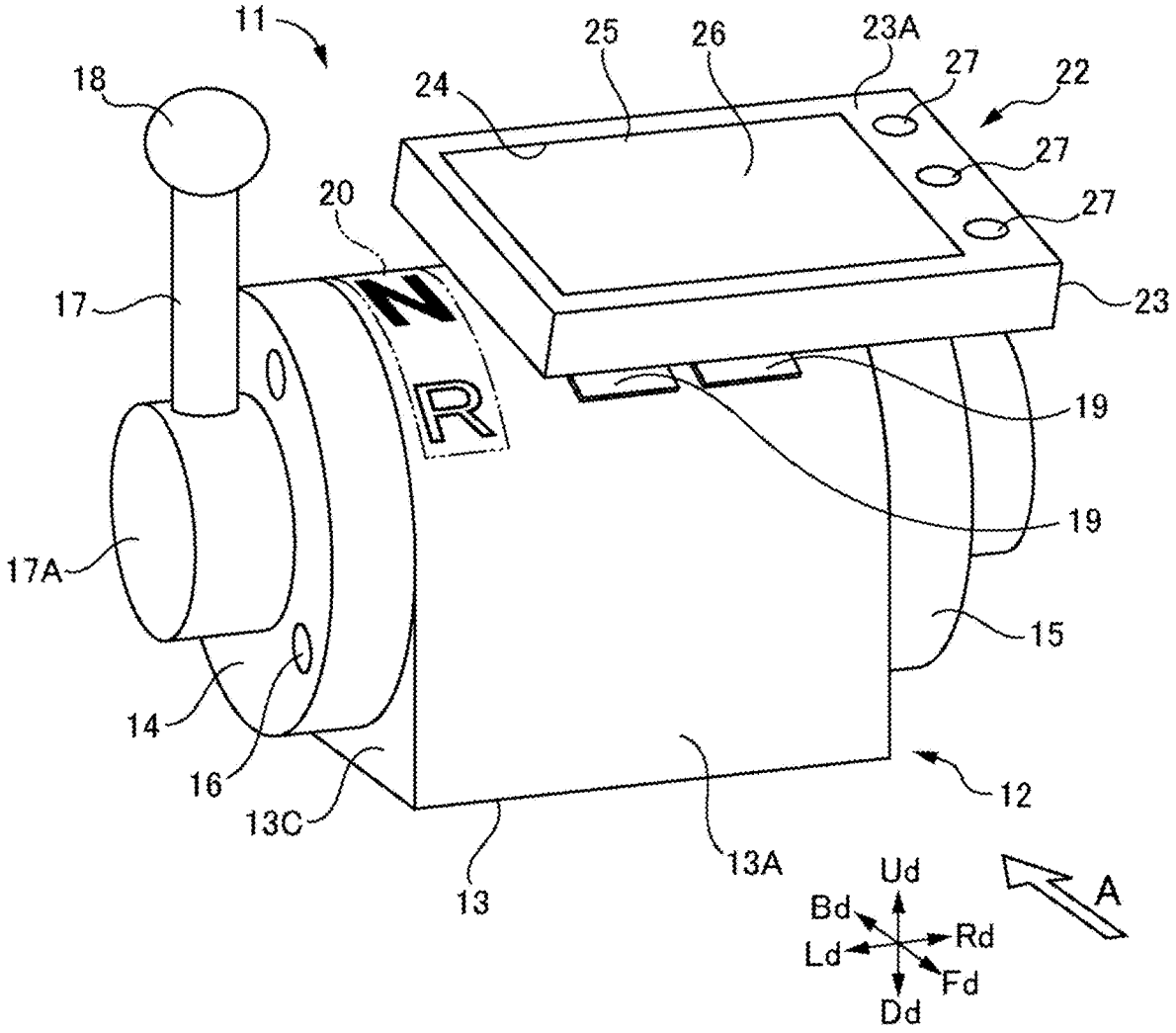
FIG. 2 is a perspective view illustrating the remote control device according to the first embodiment of the present disclosure.
Figure 3A:
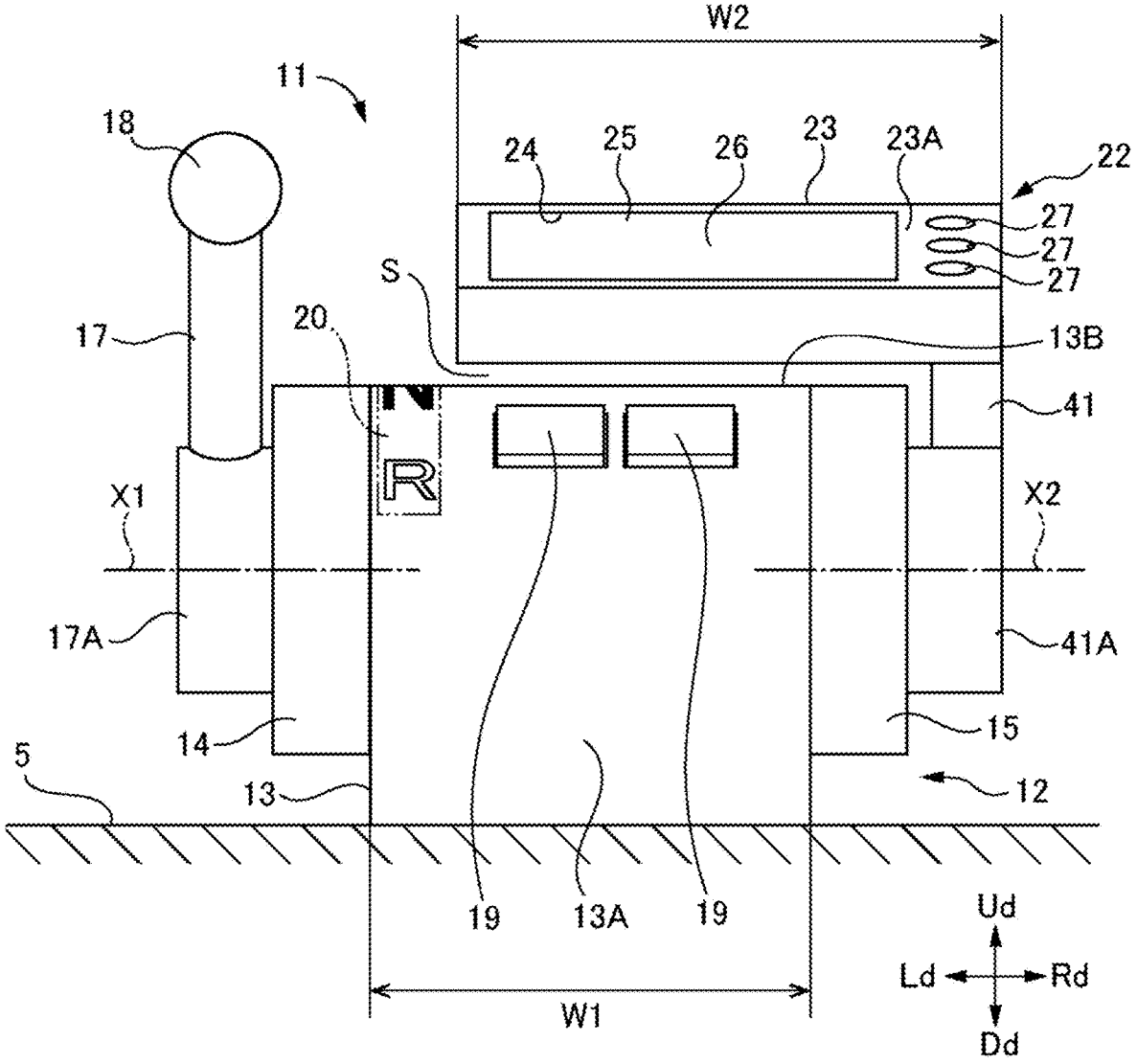
FIG. 3A is a front view of the remote control device according to the first embodiment of the present disclosure.
Figure 3B:
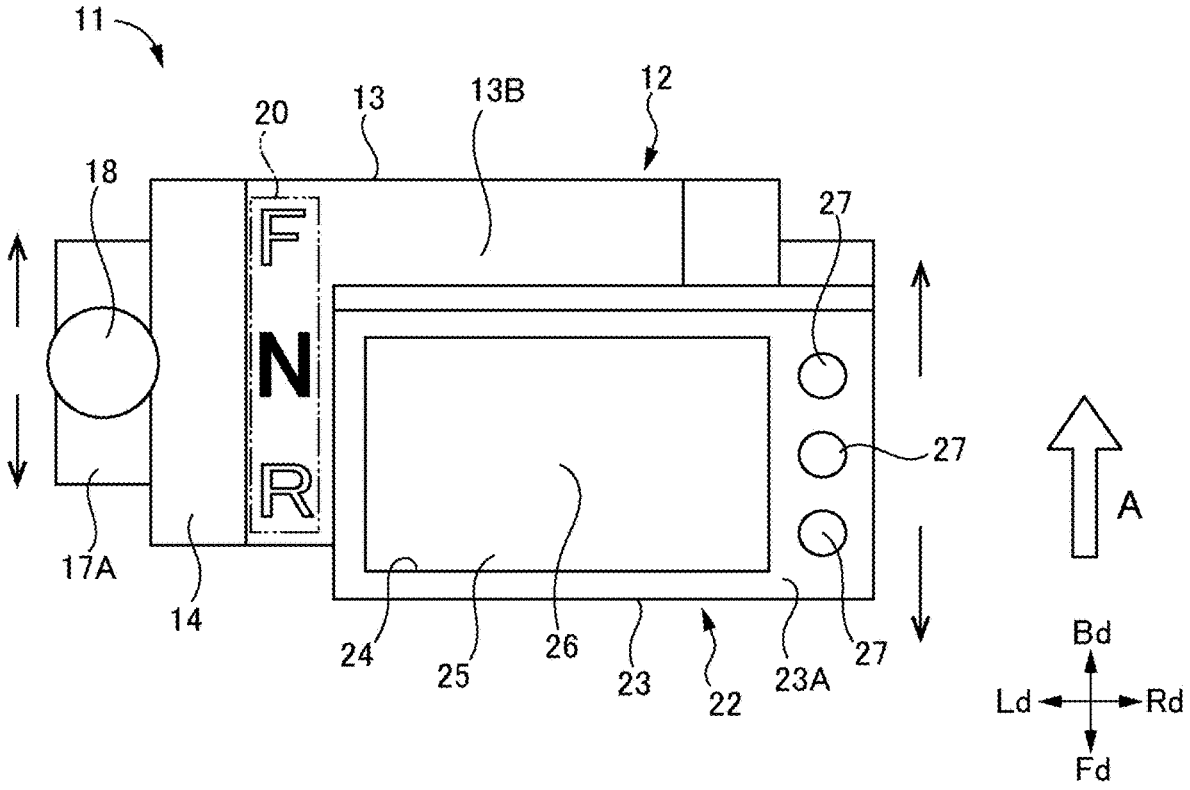
FIG. 3B is a plan view of the remote control device.
Figure 4:
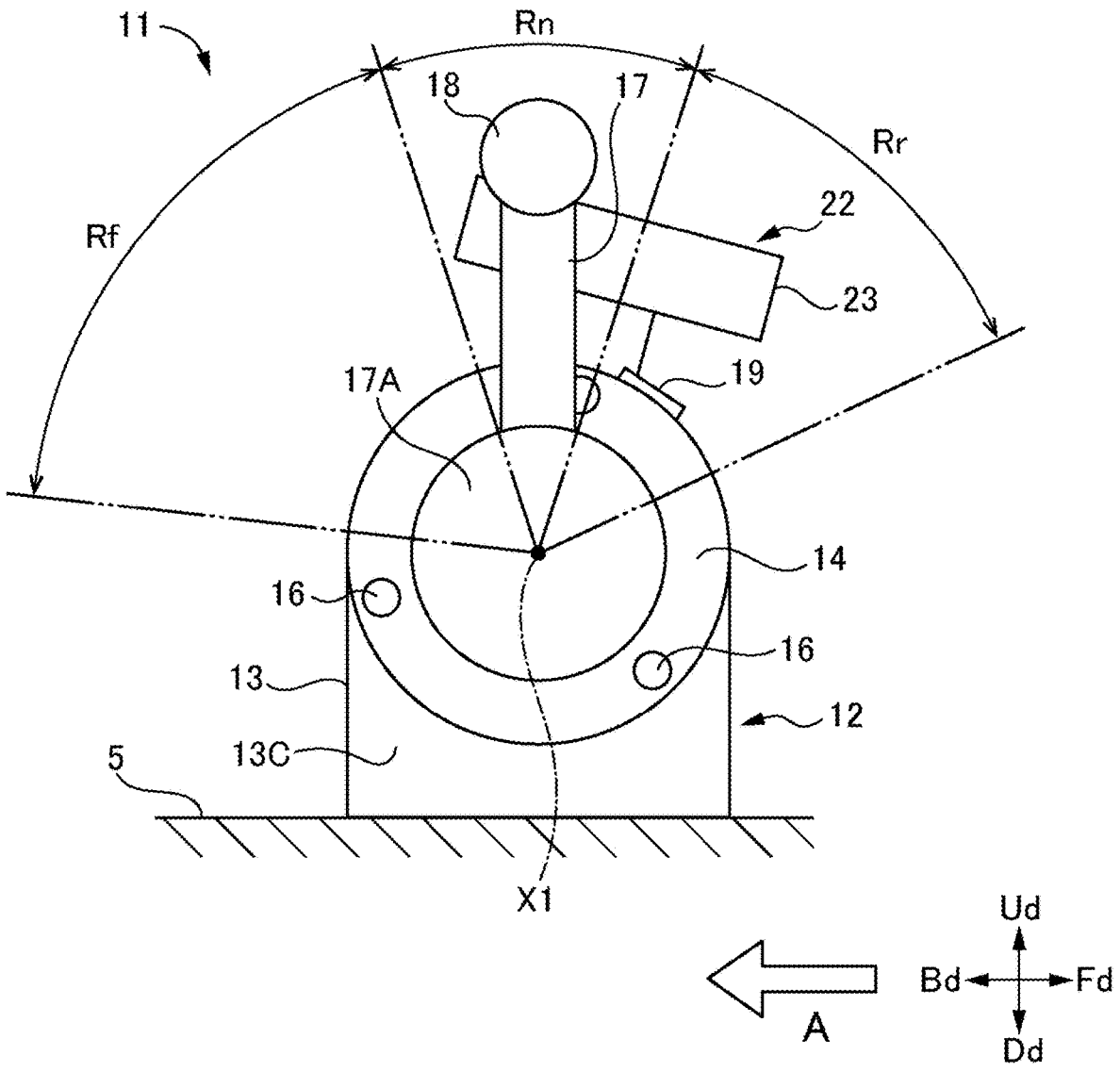
FIG. 4 is a left side view of the remote control device according to the first embodiment of the present disclosure.
Figure 5A:
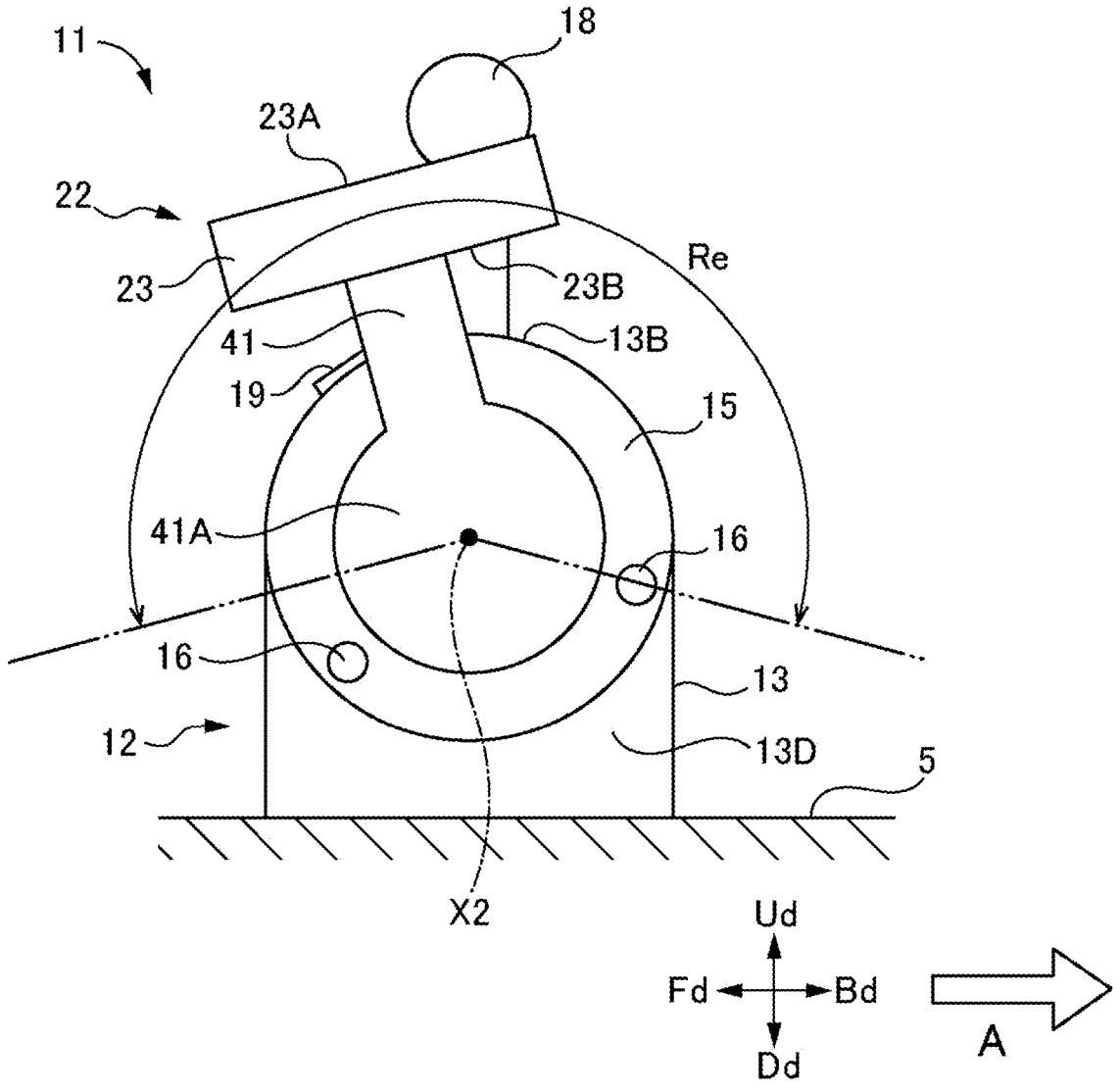
FIG. 5A is a right side view of the remote control device according to the first embodiment of the present disclosure.
Figure 6:
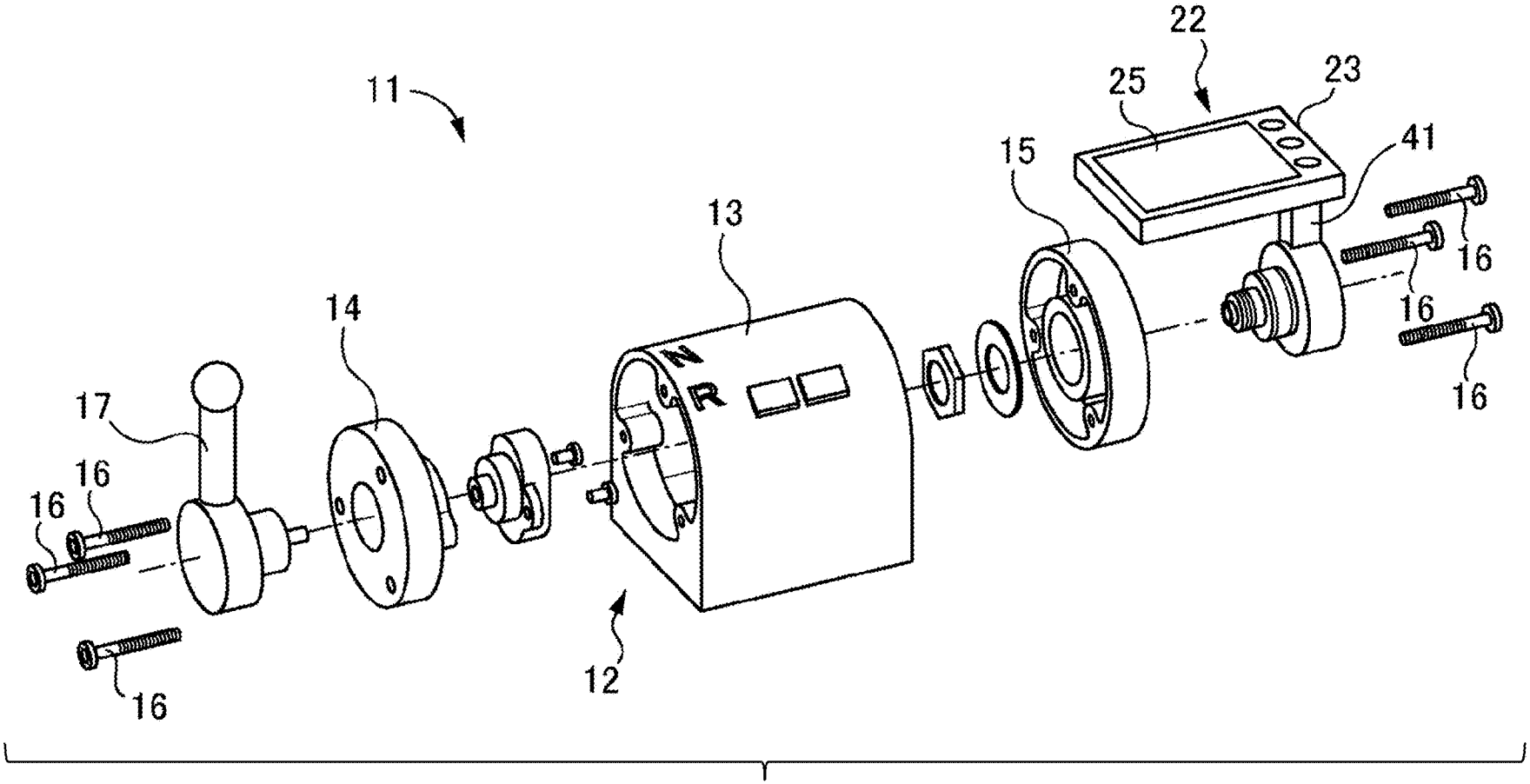
FIG. 6 is an exploded view of the remote control device according to the first embodiment of the present disclosure.

FIG. 2 illustrates a state in which the remote control device 11 is viewed from the front upper left. FIG. 3A illustrates a state in which the remote control device 11 is viewed from the front. FIG. 3B illustrates a state in which the remote control device 11 is viewed from the above. FIG. 4 illustrates a state in which the remote control device 11 is viewed from the left. FIG. 5A illustrates a state in which the remote control device 11 is viewed from the right. FIG. 6 is an exploded view of the remote control device 11.

The remote control device 11 is configured to remotely control the outboard motor 3. The remote control device 11 has, in addition to a function of remotely controlling the outboard motor 3, a function of displaying various kinds of information related to the outboard motor 3, the ship 1, and the like.

As illustrated in FIG. 3A, the remote control device 11 includes a remote control device main body 12, a display unit 22, and a support arm 41. The remote control device main body 12 and the display unit 22 are separate and independent units. The display unit 22 is provided outside a main body case 13 of the remote control device main body 12. The remote control device main body 12 and the display unit 22 are coupled by the support arm 41. The support arm 41 is a specific example of a "support mechanism".

(Remote Control Device Main Body)

The remote control device main body 12 includes the main body case 13, a lever pivot portion 14, an arm pivot portion 15, and a remote control lever 17.

As illustrated in FIGS. 2, 3B, 4, and 5A, the main body case 13 is formed in a box shape having a front surface 13A, a rear surface, an upper surface 13B, a lower surface, a left surface 13C, and a right surface 13D. The upper surface 13B of the main body case 13 is curved such that the upper surface 13B draws an arc centered on a rotation axis X1 of the remote control lever 17 and a rotation axis X2 of the support arm 41.

The remote control device 11 is installed on the installation surface 5. Specifically, as illustrated in FIGS. 3A, 4, and 5A, the main body case 13 of the remote control device main body 12 is installed on the installation surface 5. Specifically, the main body case 13 is placed on the installation surface 5 and attached and fixed to the installation surface 5. When the main body case 13 is placed on the installation surface 5, the lower surface of the main body case 13 faces the installation surface 5. For example, when the main body case 13 is placed on the installation surface 5, the lower surface of the main body case 13 is in contact with the installation surface 5.

The lever pivot portion 14 for supporting the remote control lever 17 is attached to a left end portion of the main body case 13. In addition, the arm pivot portion 15 for supporting the support arm 41 is attached to a right end portion of the main body case 13. As illustrated in FIG. 6, the lever pivot portion 14 and the arm pivot portion 15 are fixed to the main body case 13 using bolts 16. In addition, as illustrated in FIG. 3A, the lever pivot portion 14 and the arm pivot portion 15 are both separated from the installation surface 5.

The remote control lever 17 is attached to a left end side of the main body case 13. The remote control lever 17 is configured to be rotated in the front-back direction with respect to the main body case 13. The rotation axis X1 of the remote control lever 17 extends in the left-right direction and passes through the main body case 13. The remote control lever 17 extends in a direction perpendicular to the rotation axis X1. A base end portion 17A of the remote control lever 17 is attached to the lever pivot portion 14 such that the base end portion 17A is configured to be rotated about the rotation axis X1 with respect to the lever pivot portion 14. By attaching and fixing the lever pivot portion 14 to the left end portion of the main body case 13, the remote control lever 17 is coupled to the main body case 13 such that the remote control lever 17 is configured to be rotated about the rotation axis X1 with respect to the main body case 13. In addition, a grip portion 18 is provided at a distal end portion of the remote control lever 17. The ship operator can control a magnitude or a direction of a propulsive force of the ship 1 generated by the outboard motor 3 by grasping the grip portion 18 and changing an inclination angle of the remote control lever 17.

Here, with respect to the inclination angle of the remote control lever 17 and the propulsive force generated by the outboard motor 3, a case where a power source of the outboard motor 3 is an engine and the outboard motor 3 is provided with a clutch will be described as an example with reference to FIG. 4, the clutch executing switching of whether to transmit rotation of the engine to a propeller shaft and executing switching of whether to cause the propeller shaft to rotate forward or backward in accordance with the rotation of the engine.

In a case where the inclination angle of the remote control lever 17 is within a neutral range Rn in FIG. 4, the clutch is switched in the outboard motor 3 such that the rotation of the engine is not transmitted to the propeller shaft (neutral state). Accordingly, the propulsive force of the ship 1 is not generated by the outboard motor 3.

In a case where the inclination angle of the remote control lever 17 is within a forward range Rf in FIG. 4, the clutch is switched in the outboard motor 3 such that the rotation of the engine is transmitted to the propeller shaft and the propeller shaft rotates forward with the rotation of the engine. Accordingly, a propulsive force for pushing the ship 1 forward is generated by the outboard motor 3.

In a case where the inclination angle of the remote control lever 17 is within a reverse range Rr in FIG. 4, the clutch is switched in the outboard motor 3 such that the rotation of the engine is transmitted to the propeller shaft and the propeller shaft rotates backward with the rotation of the engine. Accordingly, a propulsive force for pushing the ship 1 rearward is generated by the outboard motor 3.

As illustrated in FIG. 3A, a plurality of operation switches 19 are provided on a front portion of the upper surface 13B of the main body case 13. For example, two of operation switches 19 are provided on a front portion of the upper surface 13B of the main body case 13. For example, the operation switch 19 on a left side of the two operation switches 19 is a neutral switch. The neutral switch is a switch for switching the clutch such that the outboard motor 3 is in the neutral state regardless of the inclination angle of the remote control lever 17. In addition, the operation switch 19 on a right side is an operator seat changeover switch. The operator seat changeover switch is a switch for selecting, in a case where a plurality of remote control devices 11 are provided in the ship, a remote control device 11 configured to operate the outboard motor 3 from the plurality of remote control devices 11.

As illustrated in FIG. 3B, a lever position display lamp 20 is provided on a left portion of the upper surface 13B of the main body case 13. The lever position display lamp 20 is a lamp indicating a position of the remote control lever 17. A lamp of "N" is turned on in a case where the remote control lever 17 is in the neutral range Rn. A lamp of "F" is turned on in a case where the remote control lever 17 is in the forward range Rf. A lamp of "R" is turned on in a case where the remote control lever 17 is in the reverse range Rr.

(Display Unit)

The display unit 22 includes a display case 23 and a display 25.

The display case 23 is formed in a rectangular parallelepiped shape close to a flat plate, as illustrated in FIG. 3A. The display case 23 has a front surface 23A and a back surface 23B, as illustrated in FIG. 5A. The display 25 is, for example, a liquid crystal display or an organic electroluminescence display. The display 25 is provided in the display case 23. A window 24 is provided on the front surface 23A of the display case 23. The display 25 is disposed in the display case 23 such that a screen 26 faces the window 24. The ship operator can view the screen 26 of the display 25 by viewing the front surface 23A of the display case 23, and can visually recognize information displayed on the screen 26. In addition, a plurality of display operation switches 27 are provided on a right portion of the front surface 23A of the display case 23. The plurality of display operation switches 27 include, for example, a switch configured to execute switching of the information displayed on the screen 26 and a switch configured to execute adjustment of brightness of the screen 26.

The screen 26 of the display 25 is configured to display various kinds of information related to the outboard motor 3, the ship 1, and the like. For example, in a case where the power source of the outboard motor 3 is an engine, as illustrated in FIG. 1B, a rotational frequency 31 of the engine of the outboard motor 3, a speed 32 of the ship 1, a fuel balance 33 of the engine of the outboard motor 3, a trim angle 34 of the outboard motor 3, a state (shift position) 35 of the clutch of the outboard motor 3, a temperature 36 of the engine of the outboard motor 3, a fuel consumption 37, and a time 38 are simultaneously displayed on the screen 26 of the display 25.

The display 25 is a large display having a large number of pixels. A size of the display 25 is, for example, about 3 inches to 7 inches, but a display having a larger size can also be provided. Since the display 25 has a large number of pixels, information can be displayed using high-precision graphics. For example, as illustrated in FIG. 1B, the rotational frequency 31 of the engine of the outboard motor 3 can be displayed by drawing an image of an analog meter. In addition, since the display 25 has a large number of pixels, for example, as illustrated in FIG. 1B, a large amount of information related to the outboard motor 3 and the ship 1 can be simultaneously displayed on one screen. As illustrated in FIG. 3A, a length W2 of the display case 23 in the left-right direction is longer than a length W1 of the lower surface of the main body case 13 of the remote control device main body 12 in the left-right direction. Since the length W2 of the display case 23 in the left-right direction is long as described above, the large display 25 having a large number of pixels can be accommodated in the display case 23.

(Support Arm)

The support arm 41 couples the display unit 22 and the remote control device main body 12 to each other and supports the display unit 22. In addition, the support arm 41 supports the display unit 22 such that the display unit 22 is disposed at a position separated from the remote control device main body 12. As illustrated in FIG. 3A, a space S is formed between the display unit 22 and the remote control device main body 12, and the display unit 22 is not in contact with the remote control device main body 12.

The support arm 41 couples the display unit 22 and the remote control device main body 12 such that a position and an orientation of the display unit 22 with respect to the remote control device main body 12 can be changed. Specifically, the support arm 41 couples the display unit 22 and the remote control device main body 12 such that, the display unit 22 can be moved from an upper side to a front side of the remote control device main body 12 at the same time as the orientation of the display unit 22 is changed such that an orientation of the screen 26 of the display 25 is changed from upward to forward, and the display unit 22 can be moved from an upper side to a back side of the remote control device main body 12 at the same time as the orientation of the display unit 22 is changed such that the orientation of the screen 26 of the display 25 is changed from upward to backward.

More specifically, the support arm 41 is configured to be rotated in the front-back direction with respect to the remote control device main body 12. The rotation axis X2 of the support arm 41 extends in the left-right direction and passes through the main body case 13 of the remote control device main body 12. The support arm 41 extends in a direction perpendicular to the rotation axis X2. A base end portion 41A of the support arm 41 is attached to the arm pivot portion 15 such that the base end portion 41A is configured to be rotated about the rotation axis X2 with respect to the arm pivot portion 15 of the remote control device main body 12. By attaching and fixing the arm pivot portion 15 to the right end portion of the main body case 13, the base end portion 41A of the support arm 41 is coupled to the right end portion of the main body case 13 such that the base end portion 41A is configured to be rotated about the rotation axis X2 with respect to the main body case 13. In the present embodiment, the rotation axis X2 of the support arm 41 is in alignment with the rotation axis X1 of the remote control lever 17. A length of the support arm 41 is longer than any of a distance between the rotation axis X2 and the upper surface 13B of the main body case 13, a distance between the rotation axis X2 and the front surface 13A of the main body case 13, and a distance between the rotation axis X2 and the rear surface of the main body case 13.

As illustrated in FIGS. 3A and 5A, a distal end portion of the support arm 41 is coupled to a right end portion of the display case 23 of the display unit 22. In the present embodiment, the distal end portion of the support arm 41 is fixed to the right end portion of the display case 23, and the display unit 22 does not move with respect to the support arm 41. In addition, the support arm 41 is coupled to the display case 23 such that an extending direction of the support arm 41 is perpendicular to the back surface 23B of the display case 23.

Figure 5B:
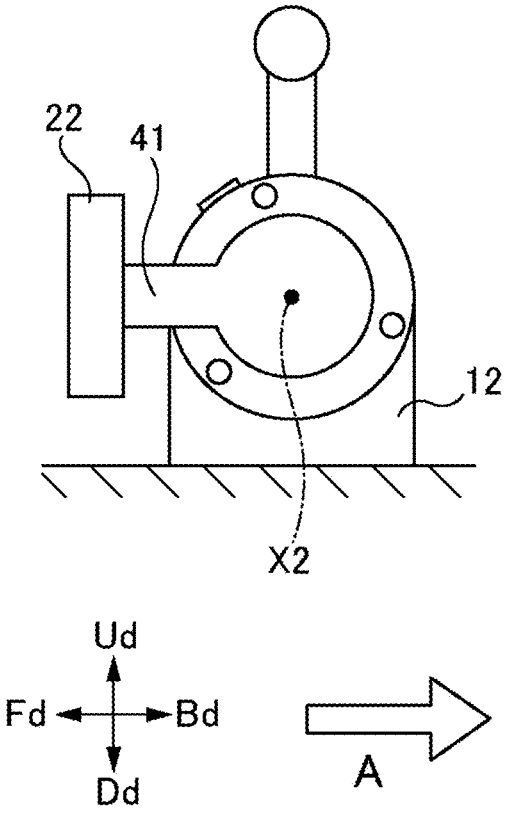
FIG. 5B is an explanatory view illustrating change in position and orientation of a display unit in the remote control device.
Figure 5C:
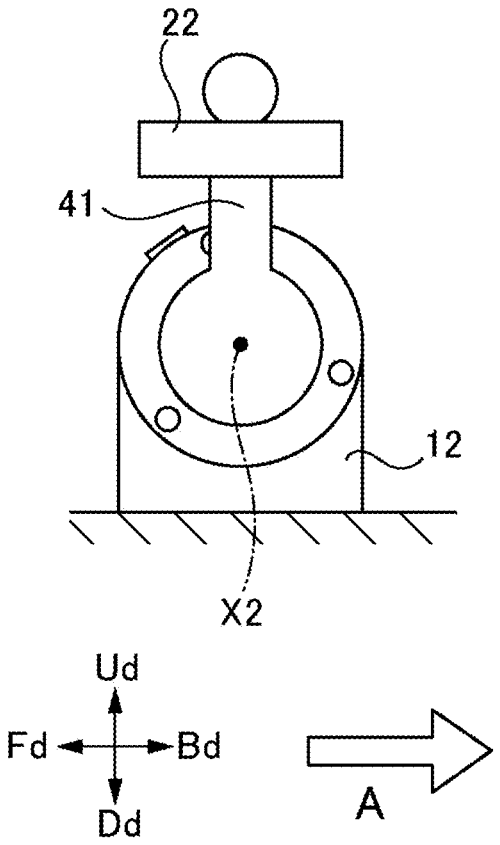
FIG. 5C is an explanatory view illustrating change in position and orientation of the display unit in the remote control device.
Figure 5D:
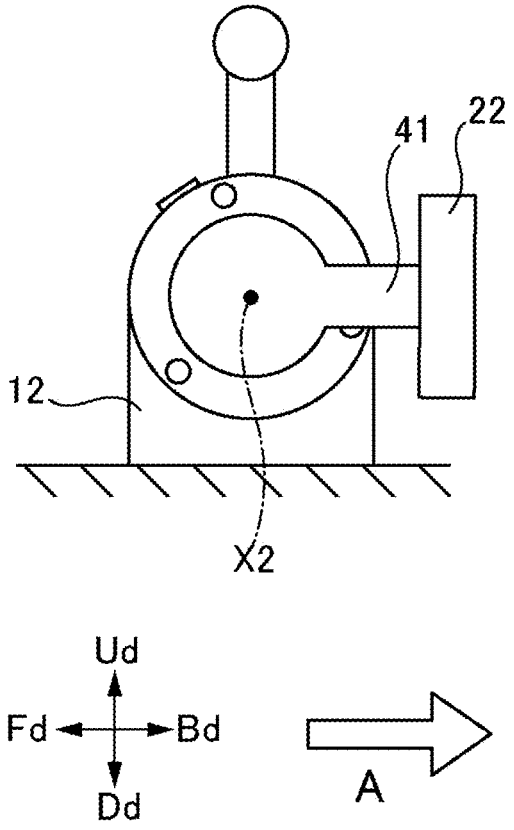
FIG. 5D is an explanatory view illustrating change in position and orientation of the display unit in the remote control device.

Since the display unit 22 is coupled to the remote control device main body 12 via the support arm 41 in this manner, the display unit 22 is configured to be rotated about the rotation axis X2 with respect to the remote control device main body 12. For example, as illustrated in FIG. 5A, the display unit 22 is configured to be rotated within a rotation range Re. In addition, since the upper surface 13B of the main body case 13 is curved such that the upper surface 13B draws an arc centered on the rotation axis X2, the display unit 22 is displaced along the upper surface 13B. For example, the ship operator can position the display unit 22 above the remote control device main body 12 as illustrated in FIG. 5C by holding and rotating the display unit 22 by hand. In this case, the screen 26 of the display 25 faces upward. As illustrated in FIG. 5B, the ship operator can position the display unit 22 in front of the remote control device main body 12. In this case, the screen 26 of the display 25 faces forward. In addition, as illustrated in FIG. 5D, the ship operator can position the display unit 22 behind the remote control device main body 12. In this case, the screen 26 of the display 25 faces backward. Further, it is preferable to provide a detent mechanism or a set screw for stopping the rotation of the support arm 41 to hold the display unit 22 in the arm pivot portion 15.

As illustrated in FIG. 5A, when the display unit 22 is positioned on substantially a front upper side of the remote control device main body 12, the back surface 23B of the display case 23 and the operation switch 19 provided on the main body case 13 of the remote control device main body 12 face each other. In a case where it is difficult for the ship operator to operate the operation switch 19 in this state, the ship operator can make the operation switch 19 easier to be operated by rotating the display unit 22 to a position where the back surface 23B of the display case 23 and the operation switch 19 do not face each other as illustrated in FIG. 5B, FIG. 5C, or the like.

As described above, in the remote control device 11 according to the first embodiment of the present disclosure, the main body case 13 of the remote control device main body 12 is installed on the installation surface 5 of the console 4. In addition, the display unit 22 is provided outside the main body case 13. Further, the display unit 22 is coupled to the remote control device main body 12 by the support arm 41 and is disposed at a position separated from the remote control device main body 12. According to this configuration, even in a case where the display 25 is provided in the remote control device 11, it is possible to prevent an increase in area of the installation surface 5 on the ship side required for installation of the remote control device 11.

That is, in the remote control device 11, the main body case 13 of the remote control device main body 12 is installed on the installation surface 5. Accordingly, it is possible to prevent the increase in area of the installation surface 5 required for installation of the remote control device 11 by preventing an increase in size of the main body case 13. In the remote control device 11, the display 25 is provided in the display case 23 of the display unit 22. The display unit 22 is provided outside the main body case 13 and is disposed at a position separated from the remote control device main body 12. Therefore, the main body case 13 can be made smaller than in a case where the display 25 is provided inside the main body case 13. Accordingly, according to the remote control device 11 of the present embodiment, even in a case where the display 25 is provided in the remote control device 11, it is possible to prevent the increase in area of the installation surface 5 on the ship side required for installation of the remote control device 11.

In the configuration of the remote control device 11 of the present embodiment, when the size of the display 25 is increased, the display unit 22 is increased in size, but the main body case 13 is not increased in size. Accordingly, according to the remote control device 11 of the present embodiment, even in a case where the display 25 provided in the remote control device 11 is a large display having a large number of pixels, it is possible to prevent the increase in area of the installation surface 5 on the ship side required for installation of the remote control device 11.

Figure 7:
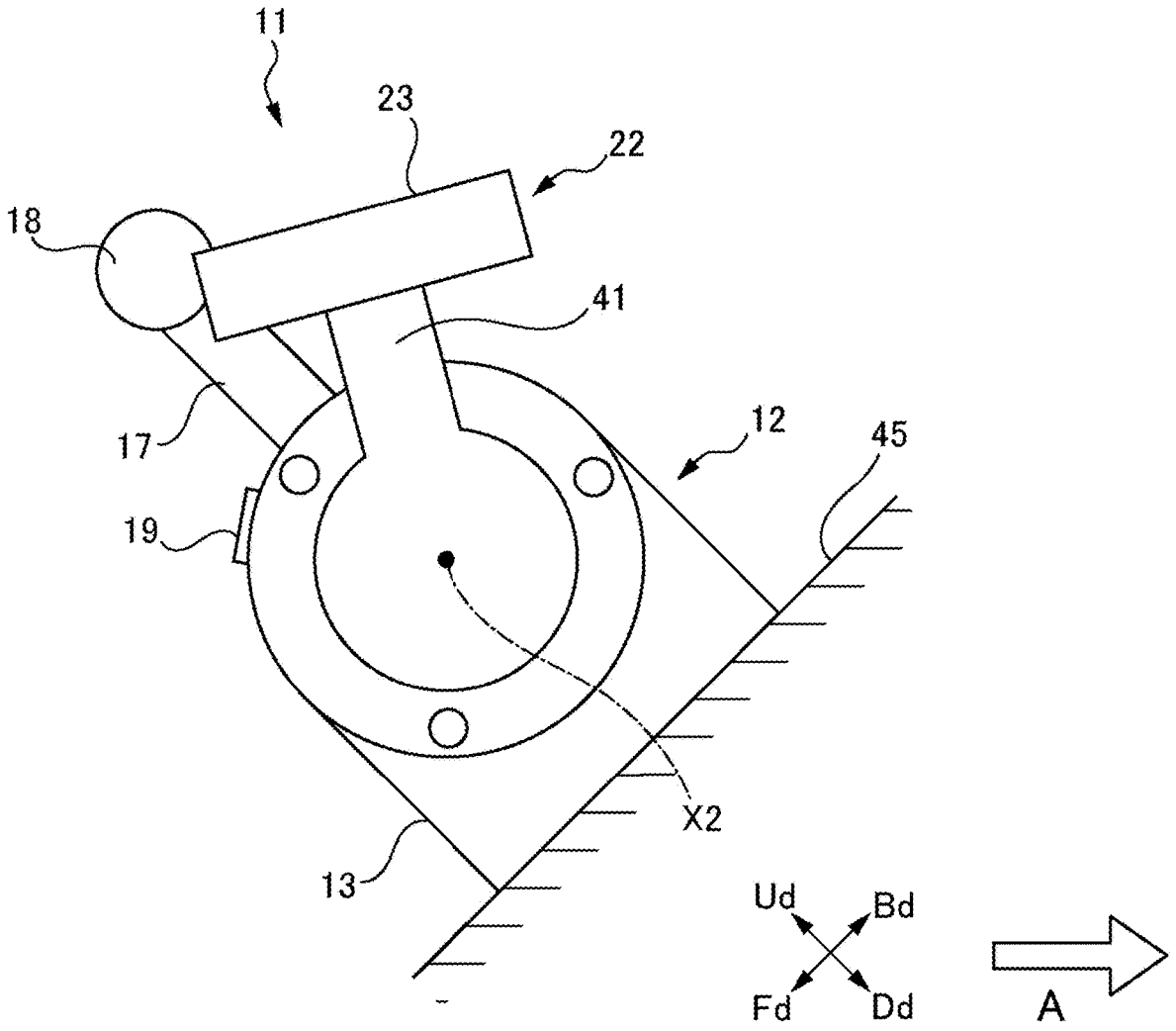
FIG. 7 is an explanatory view illustrating a state in which the remote control device according to the first embodiment of the present disclosure is installed on an inclined installation surface.

In the remote control device 11 of the present embodiment, the support arm 41 couples the display unit 22 and the remote control device main body 12 such that the display unit 22 can be moved from the upper side to the front side of the remote control device main body 12 and the display unit 22 can be moved from the upper side to the back side of the remote control device main body 12. With this configuration, the ship operator can change the position of the display unit 22 such that the screen 26 of the display 25 is easily viewed. For example, the ship operator can change the position of the display unit 22 such that the screen 26 of the display 25 can be easily viewed according to an inclination angle of the installation surface on which the remote control device 11 is installed. Specifically, as illustrated in FIG. 5A, in a case where the installation surface 5 on which the remote control device 11 is installed is horizontal, the ship operator can position the display unit 22 on a front upper side or an upper side of the remote control device main body 12 such that the screen 26 of the display 25 can be easily viewed. In addition, as illustrated in FIG. 7, in a case where an installation surface 45 on which the remote control device 11 is installed is inclined, the ship operator can position the display unit 22 on a back upper side of the remote control device main body 12 such that the screen 26 of the display 25 can be easily viewed.

In the remote control device 11 of the present embodiment, the rotation range Re of the support arm 41 is set such that the display unit 22 can be moved from a position where the back surface 23B of the display case 23 and the operation switch 19 face each other to a position where the back surface 23B of the display case 23 and the operation switch 19 do not face each other. With this configuration, in a case where the display unit 22 is at the position where the back surface 23B of the display case 23 and the operation switch 19 face each other and thus the ship operator cannot easily operate the operation switch 19, the ship operator can make the operation switch 19 easier to be operated by changing the position of the display unit 22 to the position where the back surface 23B of the display case 23 and the operation switch 19 do not face each other.

In the remote control device 11 of the present embodiment, the support arm 41 couples the display unit 22 and the remote control device main body 12 such that the orientation of the display unit 22 can be changed from upward to forward and the orientation of the display unit 22 can be changed from upward to backward. With this configuration, the ship operator can change the orientation of the display unit 22 such that the screen 26 of the display 25 is easily viewed. For example, external light such as sunlight is reflected by the screen 26 of the display 25 and enters eyes of the ship operator, and thus the information displayed on the screen 26 of the display 25 may be difficult to be viewed. In such a case, the ship operator can change the orientation of the display unit 22 such that the external light reflected by the screen 26 of the display 25 does not enter the eyes, thereby making it easy to view the information displayed on the screen 26 of the display 25.

In the remote control device 11 of the present embodiment, the length W2 of the display case 23 in the left-right direction is longer than the length W1 of the lower surface of the main body case 13 facing the installation surface 5 in the left-right direction. By increasing the length W2 of the display case 23 in the left-right direction, the large display 25 having a large number of pixels can be accommodated in the display case 23. Further, by shortening the length W1 of the lower surface of the main body case 13 facing the installation surface 5 in the left-right direction, the area of the installation surface 5 required for installation of the remote control device 11 can be reduced. According to the remote control device 11 of the present embodiment, the area of the installation surface 5 required for installation of the remote control device 11 can be reduced while providing the large display 25 having a large number of pixels.

In the remote control device 11 of the present embodiment, the upper surface 13B of the main body case 13 is curved so as to draw an arc centered on the rotation axis X2 of the support arm 41. Accordingly, as compared with a case where the upper surface 13B of the main body case 13 is a flat surface parallel to the lower surface of the main body case 13, it is possible to increase an angular range of rotation of the display unit 22 and to reduce a rotation radius of the display unit 22 while avoiding a contact of the display unit 22 with the main body case 13 during the rotation.

In the remote control device 11 of the present embodiment, the rotation axis X1 of the remote control lever 17 and the rotation axis X2 of the support arm 41 are in alignment with each other. Thus, the designability of the remote control device 11 can be improved. Specifically, a track of rotation of the remote control lever 17 and a track of the rotation of the display unit 22 become similar to each other, and movement of the remote control lever 17 and movement of the display unit 22 have a sense of unity, thereby enhancing an aesthetic feeling.

In the remote control device 11 of the present embodiment, the support arm 41 is attached to the right end portion of the main body case 13, and the remote control lever 17 is attached to the left end portion of the main body case 13. As described above, the support arm 41 for supporting the display unit 22 is provided on an end portion of the main body case 13 on one side in the left-right direction, and the remote control lever 17 is provided on an end portion of the main body case 13 on the opposite side in the left-right direction, so that the display unit 22 can be disposed at a position sufficiently separated from the remote control lever 17. Accordingly, the display unit 22 can be prevented from interfering with the operation of the remote control lever 17.

In the remote control device 11 of the present embodiment, the base end portion 41A of the support arm 41 is coupled to the right end portion of the main body case 13, the distal end portion of the support arm 41 is coupled to the right end portion of the display case 23, and the display unit 22 is disposed at a position facing the main body case 13. Thus, it is possible to prevent the display unit 22 from greatly protruding rightward from the remote control device main body 12. Accordingly, a size of the entire remote control device 11 in the left-right direction can be reduced, and a compact remote control device can be realized.

Second Embodiment

A second embodiment of the remote control device according to the present disclosure will be described with reference to FIGS. 8 and 9C. In the second embodiment, determination of the direction of the ship and determination of the direction of the remote control device are the same as those in the first embodiment. In the remote control device of the second embodiment, the same components as those of the remote control device of the first embodiment illustrated in FIGS. 1A to 7 are denoted by the same reference numerals, and the description thereof is omitted or simplified. A main difference between the remote control device of the second embodiment and the remote control device of the first embodiment is that the support arm is provided with a plurality of rotating portions.

Figure 8:
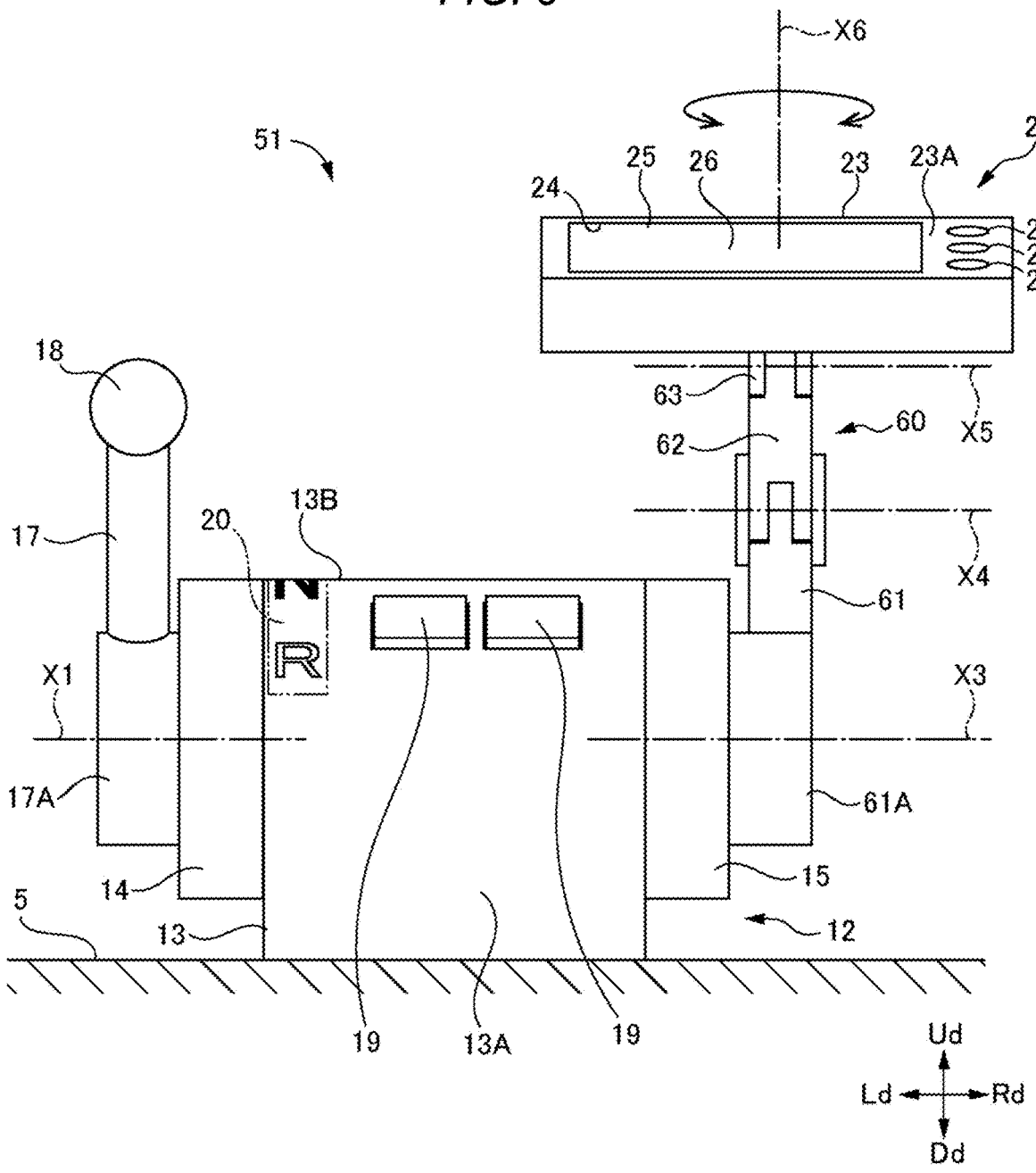
FIG. 8 is a front view of a remote control device according to a second embodiment of the present disclosure.
Figure 9A:
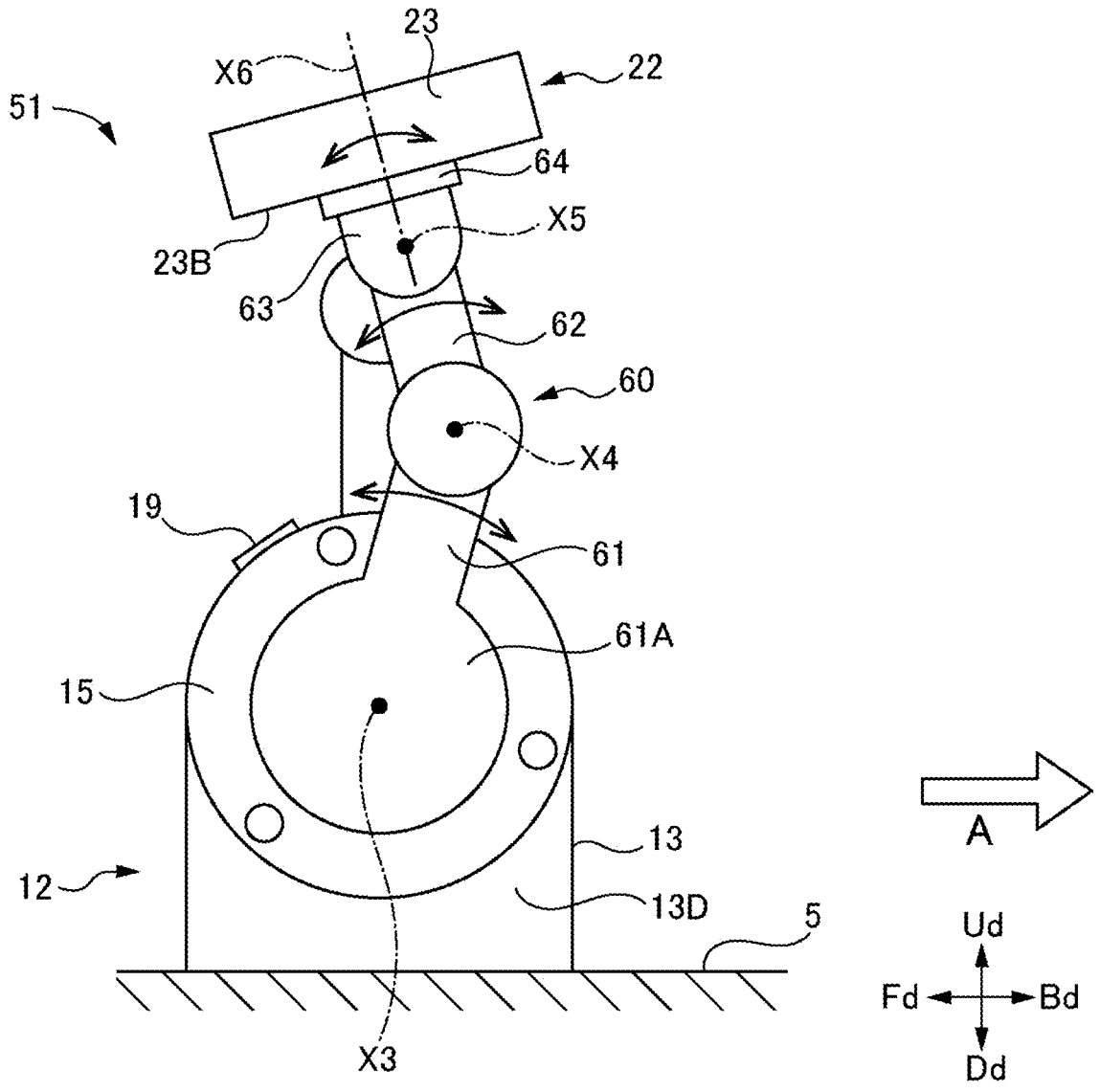
FIG. 9A is a right side view of the remote control device according to the second embodiment of the present disclosure.

FIG. 8 illustrates a state in which a remote control device 51 according to the second embodiment of the present disclosure is viewed from the front. FIG. 9A illustrates a state in which the remote control device 51 is viewed from the right.

As illustrated in FIG. 8, a support arm 60 of the remote control device 51 couples the display unit 22 and the remote control device main body 12 to each other and supports the display unit 22. In addition, the support arm 60 supports the display unit 22 such that the display unit 22 is disposed at a position separated from the remote control device main body 12. Further, the support arm 60 couples the display unit 22 and the remote control device main body 12 such that the position and the orientation of the display unit 22 with respect to the remote control device main body 12 can be changed.

The support arm 60 includes a first arm piece 61 forming a base end side portion of the support arm 60 and a second arm piece 62 forming a distal end side portion of the support arm 60.

The first arm piece 61 is configured to be rotated in the front-back direction with respect to the remote control device main body 12. A rotation axis X3 of the first arm piece 61 extends in the left-right direction and passes through the main body case 13 of the remote control device main body 12. The first arm piece 61 extends in a direction perpendicular to the rotation axis X3. A base end portion 61A of the first arm piece 61 is attached to the arm pivot portion 15 such that the base end portion 61A is configured to be rotated about the rotation axis X3 with respect to the arm pivot portion 15 of the remote control device main body 12. By attaching and fixing the arm pivot portion 15 to the right end portion of the main body case 13, the base end portion 61A of the first arm piece 61 is coupled to the right end portion of the main body case 13 such that the base end portion 61A is configured to be rotated about the rotation axis X3 with respect to the main body case 13. The base end portion 61A of the first arm piece 61 corresponds to a base end portion of the support arm 60.

In the present embodiment, the rotation axis X3 of the first arm piece 61 is in alignment with the rotation axis X1 of the remote control lever 17. A length of the first arm piece 61 is longer than any of a distance between the rotation axis X3 and the upper surface 13B of the main body case 13, a distance between the rotation axis X3 and the front surface 13A of the main body case 13, and a distance between the rotation axis X3 and the rear surface of the main body case 13.

A base end portion of the second arm piece 62 is rotatably coupled to a distal end portion of the first arm piece 61. The second arm piece 62 is configured to be rotated about a rotation axis X4 with respect to the first arm piece 61. The rotation axis X4 of the second arm piece 62 extends in the left-right direction. The second arm piece 62 extends in a direction perpendicular to the rotation axis X4.

A distal end portion of the second arm piece 62 is rotatably coupled to the display unit 22. The display unit 22 is configured to be rotated about a rotation axis X5 with respect to the second arm piece 62. The rotation axis X5 of the display unit 22 extends in the left-right direction. The distal end portion of the second arm piece 62 is coupled to a central portion of the back surface 23B of the display case 23 of the display unit 22. A bracket 63 is provided at the central portion of the back surface 23B of the display case 23 of the display unit 22 in the present embodiment, and the distal end portion of the second arm piece 62 is rotatably attached to the bracket 63. The distal end portion of the second arm piece 62 corresponds to a distal end portion of the support arm 60.

The display unit 22 is coupled to the distal end portion of the second arm piece 62 such that the display unit 22 is configured to be rotated about a rotation axis X6 extending in a direction perpendicular to the screen 26 of the display 25. As illustrated in FIG. 9A, the bracket 63 provided at the central portion of the back surface 23B of the display case 23 of the display unit 22 in the present embodiment is provided with a rotation mechanism 64 for supporting the display unit 22 such that the display unit 22 is configured to be rotated about the rotation axis X6.

The display unit 22 is configured to be rotated about the rotation axis X3 with respect to the remote control device main body 12. The display unit 22 is configured to be rotated about the rotation axis X4 with respect to the remote control device main body 12. The display unit 22 is configured to be rotated about the rotation axis X5 with respect to the remote control device main body 12. The display unit 22 is configured to be rotated about the rotation axis X6 with respect to the remote control device main body 12.

Figure 9B:
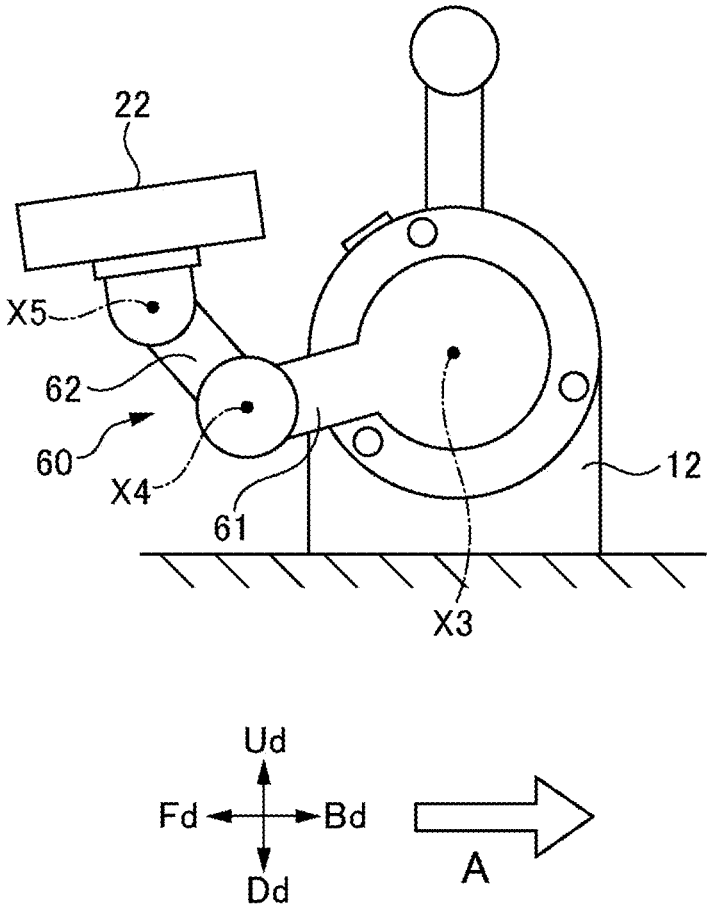
FIG. 9B is an explanatory view illustrating change in position and orientation of a display unit in the remote control device.
Figure 9C:
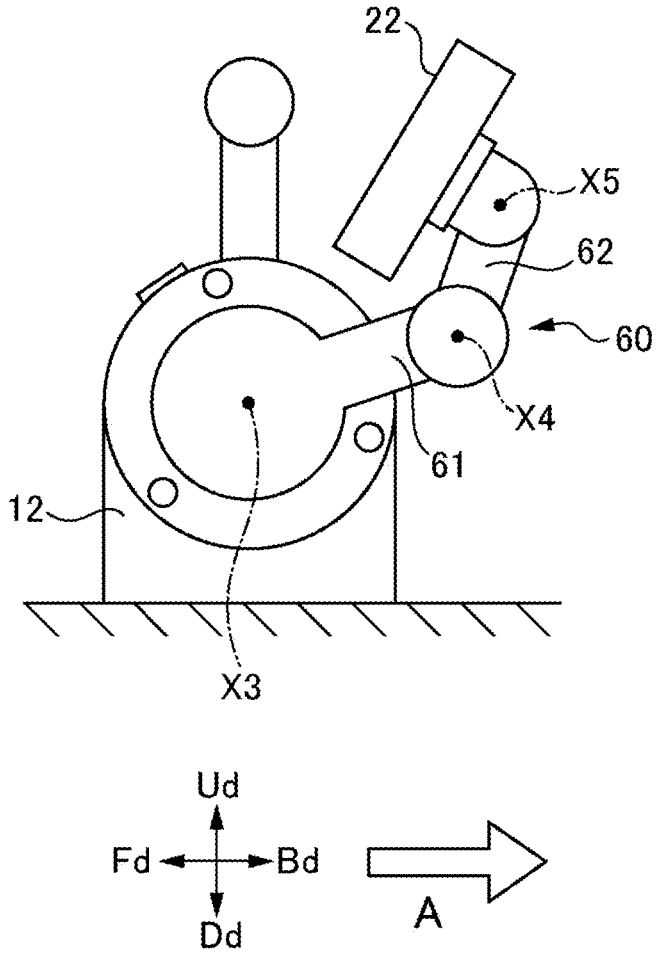
FIG. 9C is an explanatory view illustrating change in position and orientation of the display unit in the remote control device.

The remote control device 51 according to the second embodiment of the present disclosure having such a configuration has substantially the same operation and effect as that of the remote control device 11 according to the first embodiment of the present disclosure. In addition, in the remote control device 51 according to the second embodiment of the present disclosure, the display unit 22 is coupled to the distal end portion of the support arm 60 such that the display unit 22 is configured to be rotatable about the rotation axis X5, thereby improving the degree of freedom in setting the orientation of the display unit 22. Further, the support arm 60 includes the first arm piece 61 and the second arm piece 62, and the second arm piece 62 is coupled to the first arm piece 61 such that the second arm piece 62 is configured to be rotated about the rotation axis X4, thereby improving the degree of freedom in setting the position and the orientation of the display unit 22. For example, as illustrated in FIG. 9B, the orientation of the display unit 22 can be made upward while setting the position of the display unit 22 to a front side of the remote control device main body 12. In addition, as illustrated in FIG. 9C, the orientation of the display unit 22 can be made substantially forward while the position of the display unit 22 is set to a back side of the remote control device main body 12.

Further, the display unit 22 is coupled to the distal end portion of the support arm 60 so as to be rotatable about the rotation axis X6, thereby improving the degree of freedom in setting the orientation of the display unit 22. For example, the orientation of the screen 26 of the display 25 can be changed from a horizontal orientation to a vertical orientation.

In each of the above embodiments, the remote control lever 17 is disposed on a left side of the main body case 13, and the support arm 41 (60) is disposed on a right side of the main body case 13, but the present invention is not limited thereto, and the remote control lever 17 may be disposed on the right side of the main body case 13 and the support arm 41 (60) may be disposed on the left side of the main body case 13.

Figure 10A:
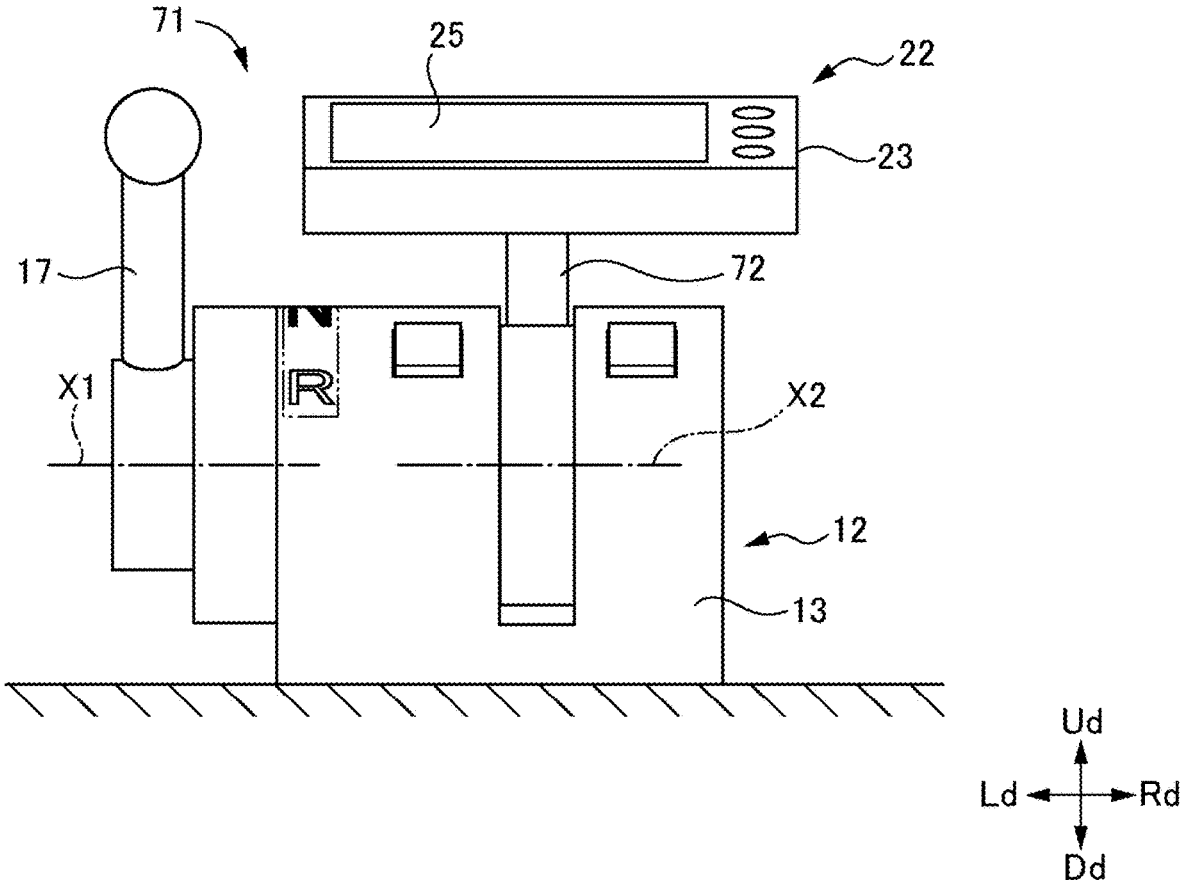
FIG. 10A is a front view of a modification of the remote control device according to the first embodiment of the present disclosure.

In each of the above embodiments, a case where the base end portion 41A (61A) of the support arm 41 (60) is coupled to the right end portion of the main body case 13 is given as an example, but the present invention is not limited thereto. For example, as in a remote control device 71 illustrated in FIG. 10A, a base end portion of a support arm 72 may be coupled to a substantially central portion of the main body case 13 in the left-right direction.

In the remote control device 11 of the first embodiment, the display unit 22 may be coupled to the distal end portion of the support arm 41 such that the display unit 22 is rotatable about the rotation axis extending in the left-right direction with respect to the support arm 41. In the remote control device 51 of the second embodiment, the display unit 22 may be fixed to the distal end portion of the second arm piece 62 such that the display unit 22 does not move with respect to the second arm piece 62. In the remote control device 51 of the second embodiment, the first arm piece 61 may be fixed to the main body case 13 such that the first arm piece 61 does not move with respect to the main body case 13. In the remote control device 51 of the second embodiment, the support arm 60 may be formed of a single rod-shaped member without being divided into the first arm piece 61 and the second arm piece 62. In the remote control device 51 of the second embodiment, the display unit 22 is rotatable about the rotation axis X6, but the display unit 22 may not rotate about the rotation axis X6.

Figure 10B:
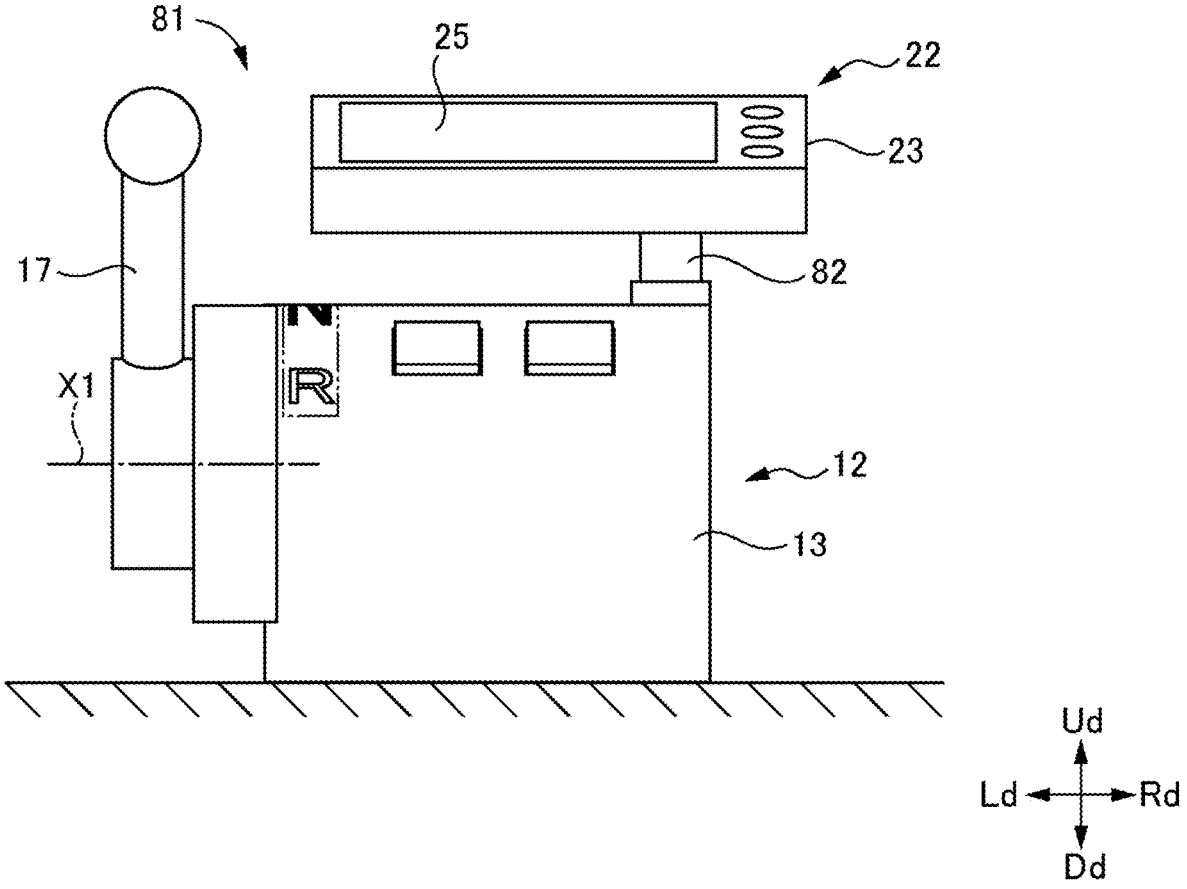
FIG. 10B is a front view of another modification of the remote control device according to the first embodiment of the present disclosure.

In each of the above embodiments, a configuration in which the position and the orientation of the display unit 22 can be changed with respect to the remote control device main body 12 is given as an example, but the present invention is not limited thereto. For example, as in a remote control device 81 illustrated in FIG. 10B, the display unit 22 may be disposed at a fixed position separated from the remote control device main body 12, and the display unit 22 may be coupled to the main body case 13 of the remote control device main body 12 via a support arm 82 such that the display unit 22 does not move with respect to the remote control device main body 12.

The ship propulsion device remotely controlled by the remote control device 11 is not limited to the outboard motor, and may be another type of ship propulsion device such as a sterndrive. In addition, the power source of the ship propulsion device may be an engine (internal combustion engine) or a motor (electric motor).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A remote control device for remotely controlling a ship propulsion device provided in a ship, the remote control device comprising:

a remote control device main body including:

a main body case installed on an installation surface provided in the ship; and a remote control lever attached to the main body case;

a display unit provided outside the main body case, and including a display case and a display provided in the display case; and a support mechanism that couples the display unit and the remote control device main body to each other, and that supports the display unit such that the display unit is disposed at a position separated from the remote control device main body, wherein the support mechanism is coupled to one end portion of the main body case in a left-right direction; and wherein the support mechanism couples the display unit and the remote control device main body such that the display unit is configured to be moved with respect to the remote control device main body.

2. A remote control device for remotely controlling a ship propulsion device provided in a ship, the remote control device comprising:

a remote control device main body including:

a main body case installed on an installation surface provided in the ship; and a remote control lever attached to the main body case;

a display unit provided outside the main body case, and including a display case and a display provided in the display case; and a support mechanism that couples the display unit and the remote control device main body to each other, and that supports the display unit such that the display unit is disposed at a position separated from the remote control device main body, wherein the support mechanism is coupled to one end portion of the main body case in a left-right direction; and wherein, in a case where a direction perpendicular to the installation surface is defined as an up-down direction and a direction perpendicular to the up-down direction is defined as a front-back direction, the support mechanism couples the display unit and the remote control device main body such that:

the support mechanism is configured to move the display unit from an upper side of the remote control device main body to a front side of the remote control device main body; or the support mechanism is configured to move the display unit from the upper side of the remote control device main body to a back side of the remote control device main body.

3. A remote control device for remotely controlling a ship propulsion device provided in a ship, the remote control device comprising:

a remote control device main body including:

a main body case installed on an installation surface provided in the ship; and a remote control lever attached to the main body case;

a display unit provided outside the main body case, and including a display case and a display provided in the display case; and a support mechanism that couples the display unit and the remote control device main body to each other, and that supports the display unit such that the display unit is disposed at a position separated from the remote control device main body, wherein the support mechanism is coupled to one end portion of the main body case in a left-right direction; and wherein, in a case where a direction perpendicular to the installation surface is defined as an up-down direction, a direction perpendicular to the up-down direction is defined as a front-back direction, and a direction perpendicular to the up-down direction and the front-back direction is defined as the left-right direction, a length of the display case in the left-right direction is longer than a length of a lower surface of the main body case facing the installation surface in the left-right direction.

* * * * *